US005602575A

United States Patent [19]

Pauly

[11] Patent Number: 5,602,575

[45] Date of Patent: Feb. 11, 1997

[54] INK JET WRITING HEAD

[75] Inventor: Manfred Pauly, Riedstadt, Germany

[73] Assignee: REA Elektronik GmbH, Darmstadt, Germany

[21] Appl. No.: 322,719

[22] Filed: Oct. 4, 1994

Related U.S. Application Data

[63] Continuation of Ser. No. 678,355, Apr. 24, 1991, abandoned.

[30] Foreign Application Priority Data

Nov. 5, 1988 [DE] Germany ..... 38 37 680.6

[51] Int. Cl.[6] ..... B41J 2/04

[52] U.S. Cl. ..... 347/54

[58] Field of Search ..... 347/54

[56] References Cited

U.S. PATENT DOCUMENTS

| | | | |
|---|---|---|---|
| 2,747,834 | 5/1956 | Meusy . | |
| 2,755,671 | 7/1956 | Delany . | |
| 3,306,570 | 2/1967 | Cooksley . | |
| 3,322,142 | 5/1967 | Baumann . | |
| 4,203,554 | 5/1980 | Zimmer et al. . | |
| 4,576,111 | 3/1986 | Slomianny | 347/54 X |
| 4,792,817 | 12/1988 | Barney | 347/54 X |
| 4,809,017 | 2/1989 | Fost | 347/54 |

FOREIGN PATENT DOCUMENTS

| | | | |
|---|---|---|---|
| 1161082 | 1/1984 | Canada | B05B 1/00 |

OTHER PUBLICATIONS

Article: IBM Technical Disclosure Bulletin (vol. 19, No. 9/Feb. 1977) "Drop-On-Demand Ink Jet Printer", J. H. Meier and J. W. Raider.

*Primary Examiner*—Joseph W. Hartary
*Attorney, Agent, or Firm*—Burns, Doane, Swecker & Mathis, L.L.P.

[57] ABSTRACT

An ink chamber (2) connected to an ink pressure source is arranged in an ink jet printing head (1). Several closure elements (7), each of which closes an ink jet nozzle (5), are arranged in the ink chamber (2). Each closure element (7) is connected to a drive device via a tie rod (8). Each tie rod (8) moves out of the ink chamber (2) through an actuating opening (9). A tie rod seal arranged at each actuating opening (9) consists of a slim, conical frustrum-shaped sealing sleeve (12) which can be elastically deformed in the axial direction, the wider end of which is sealingly connected to the edge of the actuating opening (9) and the narrower end of which sealingly surrounds the tie rod (8). When the tie rod (8) moves axially, the sealing sleeve (12) is only deformed axially.

12 Claims, 2 Drawing Sheets

INK JET WRITING HEAD

This application is a Continutation of application Ser. No. 07/678,355, filed Apr. 24, 1991 abandoned.

BACKGROUND OF THE INVENTION on an ink jet writing head, in particular for marking devices, with a ink chamber connected with an ink pressure source, wherein a plurality of closure elements, each closing an ink jet nozzle is located, each of said closure elements being connected with a tie rod, which moves out axially from the ink chamber and is connected with a driving device.

Ink jet writing heads of this type are used in particular as writing heads for marking devices, whereby lettering is applied to objects, for example packages, which are moved along the writing head. The ink jet nozzles of the writing head are arranged in a row tightly adjacent to each other and are actuated by the drive devices associated with each individual closure element by means of a control device, so that the lettering desired is applied to each passing object.

A design problem of ink jet writing heads of this type is due to the fact that the individual ink jet nozzles must be located with adequate tightness adjacent to each other, while the drive devices, usually electromagnets, have dimensions such that they cannot be placed as tightly together as the ink jet nozzles. For this reason, they are customarily arranged fanned out on either side of the plane containing the ink jet nozzles and their driving motion is transferred to the closure elements. This transfer may be effected by means of flexible wires, connected on one side with the closure element, and on the other with an actuating magnet (DE-OS 33 02 617). It is also known to connect each closure element with a tie rod, which at its end facing away from the closure element is joined to a tongue of the armature of an electromagnet.

As the ink in the ink chamber is under pressure, a pressure tight seal must be provided between the ink chamber and the tie rods or wires leading out of it. However, the friction generated in this seal impairs the operating safety of the ink jet writing head. On the one hand, undesirable wear is produced, while on the other, the seal friction interferes with the very rapid motion required of the closure elements.

It is therefore the object of the invention to develop an ink jet writing head of the aforementioned generic type in a manner such that it becomes possible to completely and effectively seal the tie rods leading out of the ink chamber without affecting the operation.

SUMMARY OF THE INVENTION

This object is attained by that between each actuating opening and the tie rod a tie rod seal deformable in the axial direction is provided, said tie rod seal being fixedly connected both with the actuating opening and the tie rod.

In the case of this seal not friction but an axial deformation takes place, so that the operation of the ink jet writing head is not affected by the seal. In particular, it has been found that the forces required for the axial deformation of the seal may be supplied without difficulty by the driving devices and that above all the actuating velocity is not affected. No abrasion or sealing problems appear, as the seal is connected fixedly and thus with absolute tightness both with the associated actuating opening of the ink chamber and the tie rod.

As because of the tightly adjacent arrangement of the of the ink jet nozzles there is relatively little space available in the radial direction, but adequate space in the axial direction, the seal according to the invention may have a very slender configuration. Its radial dimensions are not larger than the distance determined by the spacing of adjacent ink jet nozzles. According to a preferred embodiment of the invention the tie rod seal is a truncated cone shaped sealing sleeve, which is fastened by its wider end sealingly to the edge of the actuating opening and sealingly surrounds with its narrower end the tie rod. Such slim sealing sleeves may for example have the configuration of a folding.

In place of this, the sealing sleeve may also consist of an essentially smooth truncated cone; in this configuration for example an elastically deformable plastic or preferably caoutchouc or rubber may be used.

BRIEF DESCRIPTION OF THE DRAWINGS

Examples of embodiment of the invention are explained below with reference to the drawing, wherein.

DETAILED DESCRIPTION OF A PREFERRED EMBODIMENT OF THE INVENTION

Figure 1:
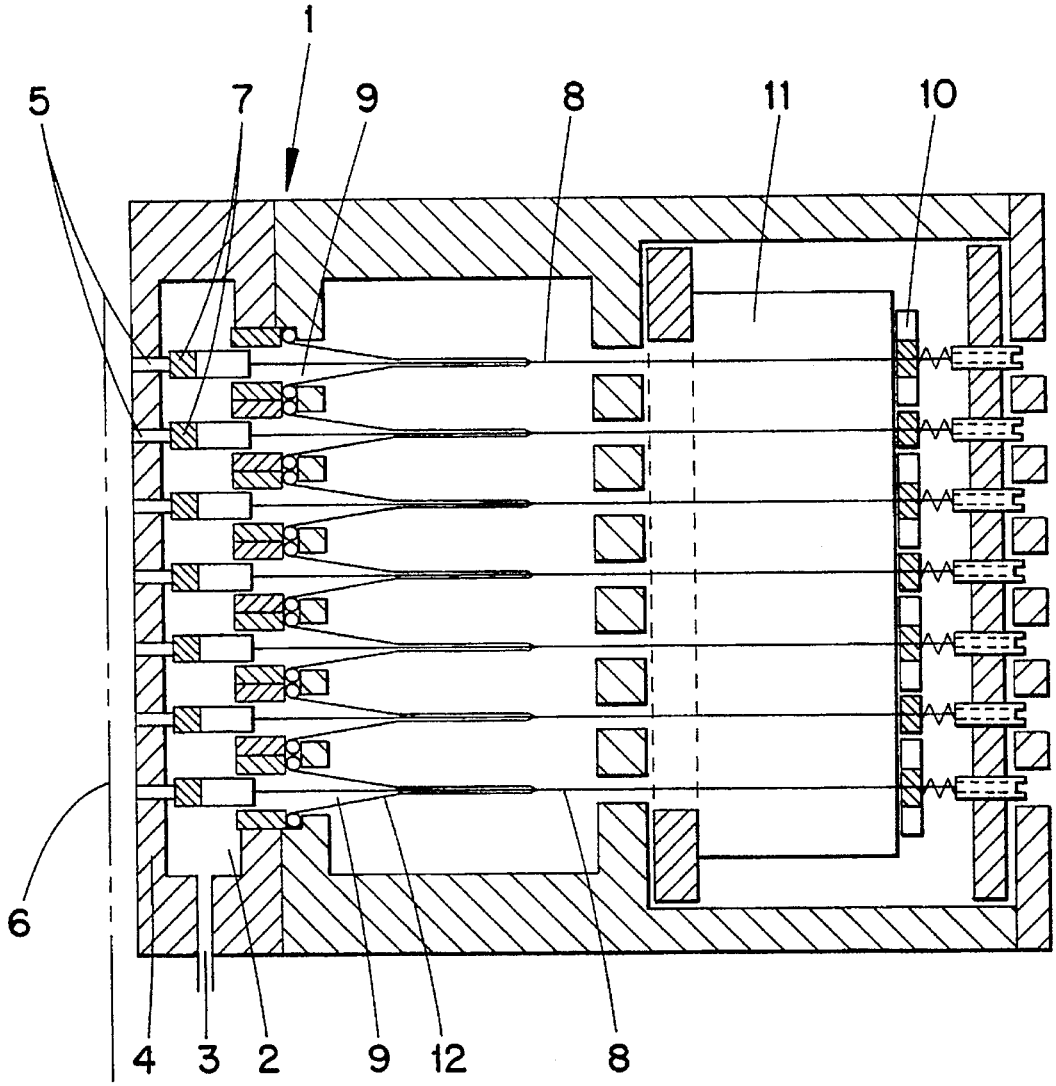
FIG. 1 shows an ink jet writing head in a section, in a simplified representation.

The ink jet writing head 1 shown in FIG. 1 contains an ink chamber 2, connected through a line 3 with a source of ink pressure (not shown), for example an ink pump. In a frontal wall 4 of the ink chamber 2 a plurality of ink jet nozzles is arranged in a row. The ink jet exiting from an ink jet nozzle 5 impacts an object 6 to be marked and moving along at a distance in front of the wall 4; with the external surface of said object being indicated in FIG. 1 by a dash-and-dot line only.

Inside the ink chamber 2, a closure element 7 is located in front of each ink jet nozzle 5. If the closure element 7 is lifted from its associated ink jet nozzle 5, an ink jet exits from the ink jet nozzle. For this purpose, each closure element 7 is connected with a tie rod 8, for example in the form of a small tube, which is moving out from the ink chamber 2 through an actuating opening 9 and is connected at its other end with a mobile armature 10 of an electromagnet 11, which is the driving device for the closure element 7. The tie rod 8 may also be in the form of a flexible wire.

Between each actuating opening 9 and the tie rod 8 moving out of it, a seal is provided in the form of a slim, truncated cone shaped sealing bush or sleeve 12, sealingly fastened with its wide end to the edge of the actuating opening 9 and again sealingly surrounding the tie rod 8 with its narrow end. Details and forms of embodiment of this seal are shown in FIGS. 2 and 3.

Figure 2:
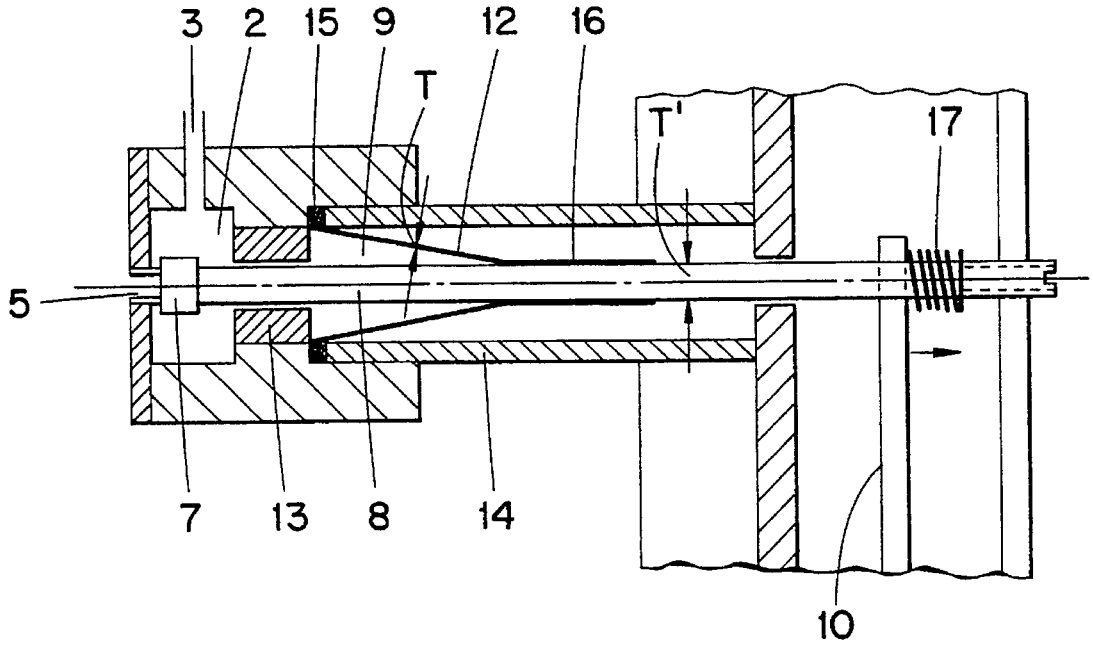
FIG. 2 an enlarged partial section through an ink jet writing head in the area of an individual ink jet nozzle and FIG. 3 a section similar to FIG. 2 of a modified form of embodiment.
Figure 3:
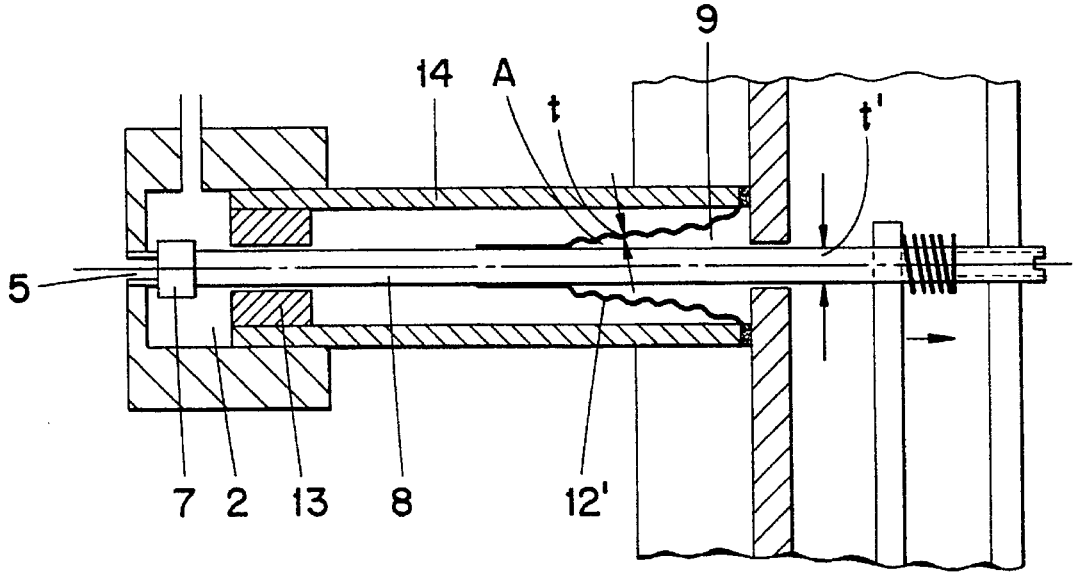

In the form of embodiment represented in FIG. 2, the tie rod is moving in an axially mobile manner in the ink chamber 2 in a guide 13, which however, is not a seal for the ink. On the side facing away from the ink jet nozzle the guide 13 is followed by a tube 14. The end of the tube 14 facing the guide 13 forms the actuating opening 9. The end of the tube is holding a bead 15 forming the wide end of the sealing sleeve 12 which here has the configuration of a smooth truncated cone which forms an acute angle A with the longitudinal axis of the tie rod 8. In this manner, the sealing sleeve 12 is seated sealingly in the actuating opening 9.

The sealing sleeve 12 tapers off in the direction away from the guide 13 and sealingly surrounds with its narrow tubular end 16 the tie rod 8. The sealing sleeve 12 here consists for example of an elastically deformable plastic or preferably of rubber. The wall thickness T of the seal 12 is substantially less than the thickness T' of the tie rod, as shown in FIG. 2.

During a pivoting motion of the armament 10 of the drive device in the direction of the arrow shown in FIG. 2 against the force of a setting spring 17, the tie rod 8 is entrained and the closure element 7 is lifted from the ink jet nozzle 5, so that an ink jet may briefly exit from the ink jet nozzle 5. In the course of this movement the sealing sleeve 12 is elastically deformed in the axial direction without sealing friction.

The example of embodiment shown in FIG. 3 differs from the example of FIG. 2 in that the essentially truncated cone shaped sealing sleeve 12' is a metal folding bellows, held sealingly with its wide end on the end of the tube 14 facing away from the ink chamber. This end of the tube 14 forms the actuating opening 9.

The sealing sleeve 12' tapers in the direction of the ink jet chamber 2 and surrounds with its narrow end, as described above, the tie rod 8. The narrow end is fixedly connected to the tie rod 8. In this form of embodiment again during the axial actuation of the tie rod 8 the sealing sleeve 12 is deformed elastically in the axial direction of the tie rod 8 without any sealing friction. The wall thickness t of the seal 12' is substantially less than the thickness t' of the tie rod 8, as shown in FIG. 3.

I claim:

1. An ink jet writing head comprising:

a stationary housing forming an ink chamber and including a plurality of ink jet nozzles communicating with said ink chamber, said ink chamber communicating with a source of pressurized ink so that jets of ink are emitted from said nozzles;

closure elements each arranged to move along an axis to open and close a respective nozzle;

springs producing a closing force for biasing respective closure elements toward their respective nozzles;

rigid force-transmitting structures for transmitting said closing forces from said springs to respective closure elements, each force-transmitting structure including a tie rod connected to a respective closure element and projecting out of said chamber through an opening formed in a wall thereof;

driving devices operably connected to respective ones of said force-transmitting structures for moving said closure elements along their respective axes away from said nozzles; and seals arranged to seal respective ones of said openings, each seal comprising a deformable element through which a respective tie rod extends, said deformable element comprising a body in the shape of a truncated cone which forms an acute angle with said axis when the respective nozzle is in a closed state, one end of the cone defining a wide end of said body, and an opposite end of the cone defining a truncated narrow end of said body, said wide end being fixedly connected to said housing in sealing relationship around a respective opening, said narrow end being fixedly connected to a respective tie rod in sealing relationship therewith, whereby said wide end is closer to said ink chamber than is said narrow end, each seal having a wall thickness substantially less than a thickness of the tie rod extending between a respective closure element and respective spring.

2. Ink jet writing head according to claim 1, wherein each driving device comprises an arm extending transversely relative to said axis and connected to a respective tie rod, one of said springs engaging said arm for biasing said arm and said tie rod toward said chamber.

3. Ink jet writing head according to claim 1, wherein said body is formed of an elastic material.

4. Ink jet writing head according to claim 1, wherein guides are arranged in said ink chamber for guiding respective tie rods, each deformable element being located on a side of a respective guide which faces away from its respective closure element.

5. Ink jet writing head according to claim 1, wherein each deformable element is located within a tube extending away from said ink chamber.

6. Ink jet writing head according to claim 5, wherein one end of said tube is sealingly connected with said wide end of a respective deformable element.

7. An ink jet writing head comprising:

a stationary housing forming an ink chamber and including a plurality of ink jet nozzles communicating with said ink chamber, said ink chamber communicating with a source of pressurized ink so that jets of ink are emitted from said nozzles;

closure elements each arranged to move along an axis to open and close a respective nozzle;

springs producing a closing force for biasing respective closure elements toward their respective nozzles;

rigid force-transmitting structures for transmitting said closing forces from said springs to respective closure elements, each force-transmitting structure including a tie rod connected to a respective closure element and projecting out of said chamber through an opening formed in a wall thereof;

said housing including tubes extending from said chamber and terminating at a housing wall spaced from said chamber, said tie rods extending through respective ones of said tubes and through respective holes formed in said wall;

driving devices operably connected to respective ones of said force-transmitting structures for moving said closure elements along their respective axes away from said nozzles; and seals arranged to seal respective ones of said holes, each sealing comprising a deformable element through which a respective tie rod extends, said deformable element comprising a body in the shape of a truncated cone which forms an acute angle with said axis when the respective nozzle is in a closed state, one end of the cone defining a wide end of said body, and an opposite end of the cone defining a truncated narrow end of said body, said wide end being fixedly connected to said housing within a respective tube in sealing relationship around a respective hole, said narrow end being fixedly connected to a respective tie rod in sealing relationship therewith, whereby said narrow end is closer to said ink chamber than is said wide end, each seal having a wall thickness substantially less than a thickness of the tie rod extending between a respective closure element and respective spring.

8. Ink jet writing head according to claim 7, wherein each driving devices comprises an arm extending transversely relative to said axis and connected to a respective tie rod, one of said springs engaging said arm for biasing said arm and said tie rod toward said chamber.

9. Ink jet writing head according to claim 7, wherein said body comprises a folding bellows.

10. Ink jet writing head according to claim 9, wherein said bellows is made of a metal.

11. Ink jet writing head according to claim 7, wherein guides are arranged in said ink chamber for guiding respective tie rods, each deformable element being located on a side of a respective guide which faces away from its respective closure element.

12. Ink jet writing head according to claim 7, wherein one end of said tube is sealingly connected with said wide end of a respective deformable element.

* * * * *